US007257964B2

(12) United States Patent
Song et al.

(10) Patent No.: US 7,257,964 B2
(45) Date of Patent: Aug. 21, 2007

(54) AIR CONDITIONER

(75) Inventors: Chan Ho Song, Kwachun-si (KR); Yoon Jei Hwang, Seoul (KR); Ji Young Jang, Sungnam-si (KR); Jeong Taek Park, Seoul (KR)

(73) Assignee: LG Electronics Inc., Seoul (KR)

( * ) Notice: Subject to any disclaimer, the term of this patent is extended or adjusted under 35 U.S.C. 154(b) by 175 days.

(21) Appl. No.: 11/105,557

(22) Filed: Apr. 14, 2005

(65) Prior Publication Data

US 2006/0123817 A1 Jun. 15, 2006

(30) Foreign Application Priority Data

Dec. 10, 2004 (KR) ..... 10-2004-0104358

(51) Int. Cl.
*F25B 1/10* (2006.01)
*F25B 39/02* (2006.01)

(52) U.S. Cl. ..... 62/510; 62/525

(58) Field of Classification Search ..... 62/199, 62/205, 278, 324.6, 510, 525, 527
See application file for complete search history.

(56) References Cited

U.S. PATENT DOCUMENTS 4,197,719 A * 4/1980 Shaw ..... 62/324.1
4,620,423 A * 11/1986 Hopkinson et al. ..... 62/77
4,643,002 A * 2/1987 Dennis et al. ..... 62/525
4,760,707 A * 8/1988 Dennis et al. ..... 62/197
4,878,357 A * 11/1989 Sekigami et al. ..... 62/160
5,067,330 A * 11/1991 Cook et al. ..... 62/485
6,880,356 B2 4/2005 Park et al.
6,952,933 B2 * 10/2005 Song et al. ..... 62/200
6,997,000 B2 * 2/2006 Hirota ..... 62/174
7,104,087 B2 * 9/2006 Park et al. ..... 62/474
7,124,595 B2 10/2006 Park et al.
2004/0134214 A1 7/2004 Song et al.
2004/0139755 A1 7/2004 Park et al.
2005/0160763 A1 * 7/2005 Choi et al. ..... 62/513

FOREIGN PATENT DOCUMENTS

CN 1517612 8/2004
JP 1-256769 A * 10/1989
JP 10-267431 10/1998
KR 1999 0038849 6/1999
KR 10-2004 0080808 9/2004
KR 2004 0094101 11/2004

OTHER PUBLICATIONS

English Language Abstract of KR 1999-0038849.
English Language Abstract of KR 2004-0094101.
English Language Abstract of EP 1443287.
English Language Abstract of KR 10-2004-0080808.
English Language Abstract of 10-267431.

* cited by examiner

*Primary Examiner*—Mohammad M. Ali
(74) *Attorney, Agent, or Firm*—Greenblum & Bernstein, P.L.C.

(57) ABSTRACT

An air conditioner incorporates valve devices mounted in a plurality of indoor units, respectively, for allowing refrigerant discharged from an outdoor heat exchanger to be introduced into one or more indoor units that are in operation. The refrigerant is prevented from being introduced into the other indoor units that are not in use, and therefore, oil is prevented from being accumulated in the other indoor units that are not in use. Also, an appropriate amount of refrigerant is supplied to the indoor units that are in operation, and therefore, reliability and efficiency of the air conditioner are improved.

18 Claims, 3 Drawing Sheets

AIR CONDITIONER

BACKGROUND OF THE INVENTION

1. Field of the Invention

The present invention relates to an air conditioner, and, more particularly, to an air conditioner incorporating valve devices for interrupting introduction of refrigerant into one or more indoor units, which are not in use, among a plurality of indoor units, whereby reliability of the air conditioner is improved.

2. Description of the Related Art

Generally, an air conditioner is an apparatus that cools or warms the interior of at least one room to provide a pleasant indoor environment. The air conditioner introduces air from the interior of the at least one room, heats or cools the introduced air, and discharges the heated or cooled air into the interior of the at least one room.

FIG. 1 is a circuit diagram schematically illustrating the structure of a conventional air conditioner.

As shown in FIG. 1, the conventional air conditioner comprises: a compressor 2 for compressing low-temperature and low-pressure gas refrigerant into high-temperature and high-pressure gas refrigerant; an outdoor heat exchanger 4 for performing heat exchange between the high-temperature and high-pressure gas refrigerant discharged from the compressor 2 and outdoor air to condense the high-temperature and high-pressure gas refrigerant into liquid refrigerant while discharging heat; an expansion device 6 for expanding the liquid refrigerant condensed by the outdoor heat exchanger 4 into low-temperature and low-pressure 2-phase refrigerant, which is composed of gas refrigerant and liquid refrigerant, and an indoor heat exchanger 8 for absorbing heat from indoor air to evaporate the low-temperature and low-pressure 2-phase refrigerant introduced from expansion device 6 into gas refrigerant.

The compressor 2 and the outdoor heat exchanger 4 are mounted in an outdoor unit 10, and the indoor heat exchanger 8 and the expansion device 6 are mounted in an indoor unit 20. The indoor unit 20 is connected to the outdoor unit 10 via service valves 22.

The compressor 2 comprises two constant-speed compressors, which are connected to each other via a common accumulator 12.

Specifically, the compressor 2 comprises first and second compressors 14 and 16, and the common accumulator 12 is connected to first and second inlet pipes 24 and 26 provided at the first and second compressors 14 and 16, respectively.

To the first and second compressors 14 and 16 are respectively connected first and second outlet pipes 28 and 30, through which high-temperature and high-pressure gas refrigerant is discharged. On the first and second outlet pipes 28 and 30 are mounted first and second check valves 32 and 34 for preventing the high-temperature and high-pressure gas refrigerant from flowing backward, respectively.

The first and second outlet pipes 28 and 30 are connected to a third outlet pipe 36 for guiding the refrigerant discharged from the compressor 2 to the outdoor heat exchanger 4.

In order to ensure that the pressure at the inlet part of the first compressor 14 is in equilibrium with the pressure at the outlet part of the first compressor 14 when the first compressor 14 is stopped, a first connection pipe 38 is connected between the first inlet pipe 24 and the first outlet pipe 28, and a first cut-off valve 40 is mounted on the first connection pipe 38.

In order to ensure that the pressure at the inlet part of the second compressor 16 is in equilibrium with the pressure at the outlet part of the second compressor 16 when the second compressor 16 is stopped, on the other hand, a second connection pipe 42 is connected between the second inlet pipe 26 and the second outlet pipe 30, and a second cut-off valve 44 is mounted on the second connection pipe 42.

The operation of the conventional air conditioner with the above-stated construction will be described below.

When the first and second compressors 14 and 16 are simultaneously operated, refrigerant compressed by the first and second compressors 14 and 16 is discharged through the first and second outlet pipes 28 and 30, and is then introduced into the outdoor heat exchanger 4 through the third outlet pipe 36.

The outdoor heat exchanger 4 performs heat exchange between the refrigerant introduced into the outdoor heat exchanger 4 and outdoor air such that heat is transferred to the outdoor air to condense the refrigerant introduced into the outdoor heat exchanger 4.

The condensed refrigerant passes through the expansion device 6. As a result, the condensed refrigerant is expanded into low-temperature and low-pressure 2-phase refrigerant. The expanded refrigerant passes through the indoor heat exchanger 8. As a result, the expanded refrigerant absorbs heat from indoor air, and therefore, the expanded refrigerant is evaporated. The evaporated refrigerant is introduced into the first and second compressors 14 and 16 through the common accumulator 12.

When the first compressor 14 is stopped, on the other hand, the first cut-off valve 40 is opened, and therefore, the refrigerant discharged from the first compressor 14 is guided into the first inlet pipe 24 through the first connection pipe 38, and is then introduced into the first compressor 14.

As a result, the first inlet pipe 24 of the first compressor 14 is in equilibrium with the first outlet pipe 28 of the first compressor 14.

In the conventional air conditioner, however, it is not possible to prevent refrigerant from being introduced into the indoor unit 20, since only the expansion device 6 is mounted in the indoor unit 20. Recently, various air conditioners each incorporating a plurality of indoor units have been proposed. In the case that the conventional air conditioner is provided with such a plurality of indoor units, refrigerant is introduced into one or more indoor units, which are not in use, among the plurality of indoor units. As a result, it is difficult to control the capacity of the air conditioner. Also, oil is accumulated in one or more indoor units, which are not in use, and therefore, reliability of the air conditioner is lowered.

SUMMARY OF THE INVENTION

Therefore, the present invention has been made in view of the above problems, and it is an object of the present invention to provide an air conditioner incorporating valve devices for interrupting introduction of refrigerant into one or more indoor units, which are not in use, whereby reliability of the air conditioner is improved.

In accordance with the present invention, the above and other objects can be accomplished by the provision of an air conditioner comprising: an outdoor heat exchanger mounted in an outdoor unit for performing heat exchange between refrigerant discharged from a compressor and outdoor air; indoor heat exchangers mounted in a plurality of indoor units, respectively; expansion devices mounted in the plurality of indoor units, respectively, for expanding refrigerant introduced into the indoor heat exchanger from the outdoor heat exchanger; and valve devices mounted in the plurality of indoor units, respectively, for allowing the refrigerant discharged from the outdoor heat exchanger to be introduced into one or more indoor units that are in operation.

Preferably, the valve devices are mounted on indoor unit refrigerant inlet pipes, which are connected to the indoor heat exchangers such that the refrigerant is introduced into the indoor heat exchangers through indoor unit refrigerant inlet pipes, respectively.

Preferably, the valve devices are cut-off valves for opening and closing the indoor unit refrigerant inlet pipes, respectively.

Preferably, the cut-off valves are disposed on the indoor unit refrigerant inlet pipes before the expansion devices, respectively.

Preferably, the air conditioner further comprises: backward-flow preventing devices disposed at the outlet parts of the indoor units for preventing refrigerant from flowing backward to the indoor units, respectively.

Preferably, the backward-flow preventing devices are check valves.

Preferably, the compressor comprises first and second compressors, which are connected to each other via a common accumulator.

Preferably, the air conditioner further comprises: a bypass device disposed between the inlet and outlet parts of the compressor for controlling the capacity of the compressor.

Preferably, the bypass device comprises: a bypass channel connected between the outlet part of the compressor and the inlet part of the common accumulator; and a cut-off valve for opening and closing the bypass channel.

Preferably, the bypass device further comprises: a capillary tube mounted on the bypass channel for reducing the pressure of the refrigerant bypassed from the outlet part of the compressor to the inlet part of the common accumulator.

According to the present invention, the air conditioner comprises valve devices mounted in a plurality of indoor units, respectively, for allowing refrigerant discharged from an outdoor heat exchanger to be introduced into one or more indoor units that are in operation. As a result, the refrigerant is prevented from being introduced into the other indoor units that are not in use, and therefore, oil is prevented from being accumulated in the other indoor units that are not in use. Also, an appropriate amount of refrigerant is supplied to the indoor units that are in operation, and therefore, reliability and efficiency of the air conditioner are improved.

Furthermore, the backward-flow preventing devices are disposed at the outlet parts of the indoor units for preventing refrigerant from flowing backward to the indoor units, and therefore, reliability of the air conditioner is further improved.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
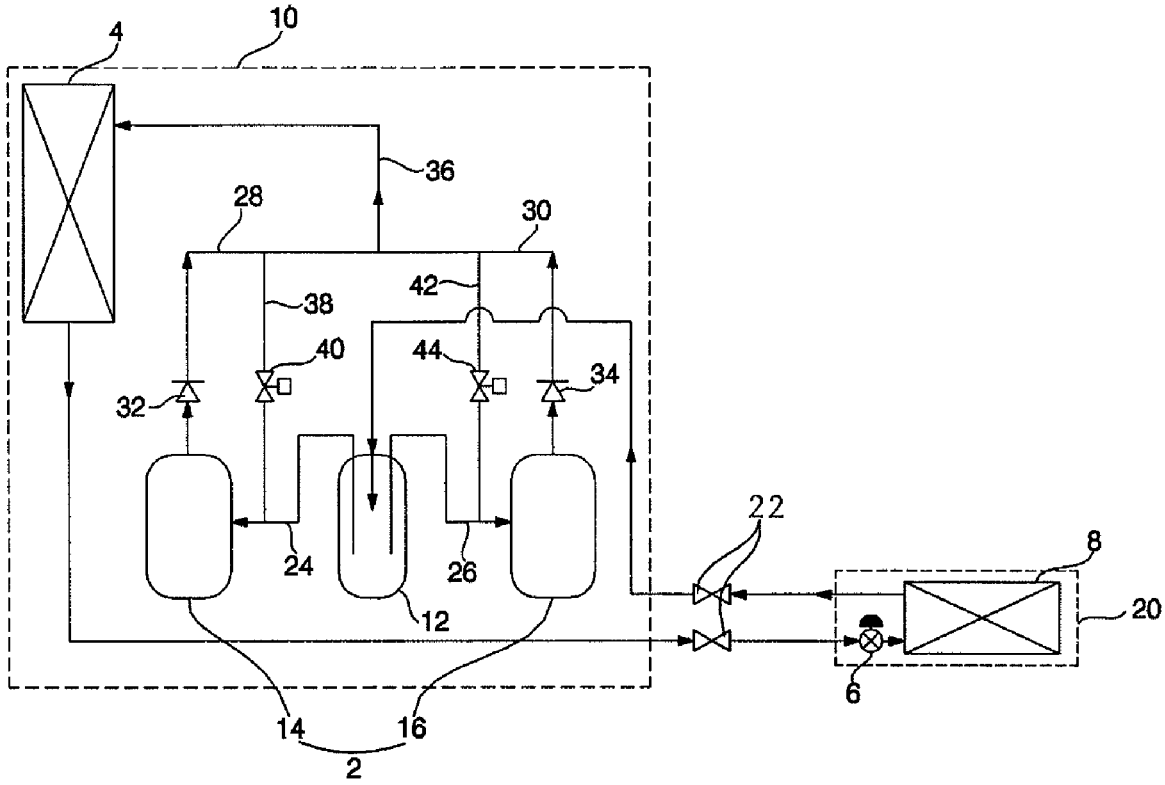
FIG. 1 (Prior art)
FIG. 1 is a circuit diagram schematically illustrating the structure of a conventional air conditioner.
Figure 2:
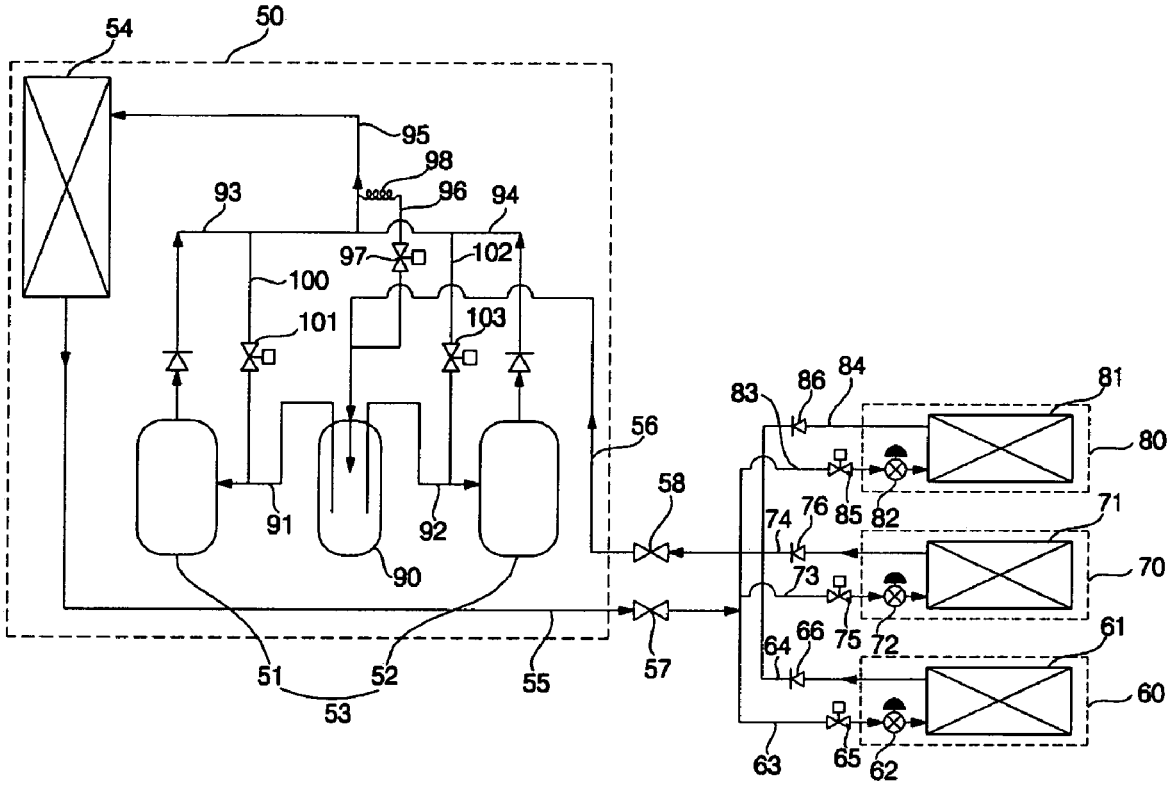
FIG. 2 is a circuit diagram schematically illustrating the structure of an air conditioner according to the present invention.

FIG. 2 is a circuit diagram schematically illustrating the structure of an air conditioner according to the present invention.

As shown in FIG. 2, the air conditioner according to the present invention comprises: an outdoor heat exchanger 54 mounted in an outdoor unit 50 for performing heat exchange between refrigerant discharged from a compressor 53 and outdoor air; indoor heat exchangers 61, 71 and 81 mounted in a plurality of indoor units 60, 70 and 80, respectively; expansion devices 62, 72 and 82 mounted in the plurality of indoor units 60, 70 and 80, respectively, for expanding refrigerant introduced into the indoor heat exchanger 61, 71 and 81 from the outdoor heat exchanger 54; and valve devices mounted in the plurality of indoor units 60, 70 and 80, respectively, for allowing the refrigerant discharged from the outdoor heat exchanger 54 to be introduced into one or more indoor units that are in operation.

In the illustrated embodiment, the air conditioner comprises three indoor units, i.e., first, second and third indoor units 60, 70 and 80, although four or more indoor units may be provided if necessary.

The outdoor heat exchanger 54 and the compressor 53 are mounted in the outdoor unit 50. The first, second and third indoor heat exchangers 61, 71 and 81 are mounted in the first, second and third indoor units 60, 70 and 80, respectively. Also, the first, second and third expansion devices 62, 72 and 82 mounted in the first, second and third indoor units 60, 70 and 80, respectively.

The outdoor unit 50 has an outdoor unit refrigerant outlet pipe 55 for guiding refrigerant discharged from the outdoor heat exchanger 54 to the first, second and third indoor units 60, 70 and 80, and an outdoor unit refrigerant inlet pipe 56 for guiding refrigerant discharged from the first, second and third indoor units 60, 70 and 80 to the outdoor unit 50.

The first, second and third indoor units 60, 70 and 80 have first, second and third indoor unit refrigerant inlet pipes 63, 73 and 83, which are connected to one sides of the first, second and third indoor heat exchangers 61, 71 and 81, respectively, for allowing refrigerant to be introduced into the first, second and third indoor heat exchangers 61, 71 and 81 therethrough. Also, the first, second and third indoor units 60, 70 and 80 have first, second and third indoor unit refrigerant outlet pipes 64, 74 and 84, which are connected to the other sides of the first, second and third indoor heat exchangers 61, 71 and 81, respectively, for allowing refrigerant to be discharged from the first, second and third indoor heat exchangers 61, 71 and 81 therethrough.

The first, second and third indoor unit refrigerant inlet pipes 63, 73 and 83 are joined together and then connected to the outdoor unit refrigerant outlet pipe 55 via a first service valve 57. Similarly, the first, second and third indoor unit refrigerant outlet pipes 64, 74 and 84 are joined together and then connected to the outdoor unit refrigerant inlet pipe 56 via a second service valve 58.

The valve devices are cut-off valves mounted on the first, second and third indoor unit refrigerant inlet pipes 63, 73 and 83 for opening and closing the first, second and third indoor unit refrigerant inlet pipes 63, 73 and 83, respectively.

Specifically, the valve devices include a first cut-off valve 65 mounted on the first indoor unit refrigerant inlet pipe 63 for closing the first indoor unit refrigerant inlet pipe 63 when the first indoor unit 60 is not in use, a second cut-off valve 75 mounted on the second indoor unit refrigerant inlet pipe 73 for closing the second indoor unit refrigerant inlet pipe 73 when the second indoor unit 70 is not in use, and a third cut-off valve 85 mounted on the third indoor unit refrigerant inlet pipe 83 for closing the third indoor unit refrigerant inlet pipe 83 when the third indoor unit 80 is not in use.

Preferably, the first, second and third cut-off valves 65, 75 and 85 are disposed before the first, second and third expansion devices 62, 72 and 82, respectively.

On the first, second and third indoor unit refrigerant outlet pipes 64, 74 and 84 are mounted backward-flow preventing devices for preventing refrigerant from flowing backward to the outlet parts of the first, second and third indoor units 60, 70 and 80, respectively.

The backward-flow preventing devices include a first-check valve 66 mounted on the first indoor unit refrigerant outlet pipe 64, a second check valve 76 mounted on the second indoor unit refrigerant outlet pipe 74, and a third check valve 86 mounted on the third indoor unit refrigerant outlet pipe 84.

The compressor 53 comprises a plurality of constant-speed compressors. In the illustrated embodiment, the compressor 53 comprises first and second compressors 51 and 52, which are connected to each other via a common accumulator 90.

The common accumulator 90 is connected to the outdoor unit refrigerant inlet pipe 56 such that refrigerant discharged from the first, second and third indoor units 60, 70 and 80 is introduced into the common accumulator 90 through the outdoor unit refrigerant inlet pipe 56. Also, the common accumulator 90 is connected to first and second compressor inlet pipes 91 and 92 provided at the first and second compressors 51 and 52, respectively, such that refrigerant is distributed to the first and second compressors 51 and 52 through first and second compressor inlet pipes 91 and 92, respectively.

To the first and second compressors 51 and 52 are connected first and second compressor outlet pipes 93 and 94 for discharging high-temperature and high-pressure gas refrigerant, respectively. The first and second compressor outlet pipes 93 and 94 are connected to one end of a third compressor outlet pipe 95, the other end of which is connected to the inlet part of the outdoor heat exchanger 54, such that the refrigerant discharged from the first and second compressor outlet pipes 93 and 94 is introduced into the outdoor heat exchanger 54 through third compressor outlet pipe 95.

Between the inlet and outlet parts of the first and second compressors 51 and 52 is disposed a bypass device for controlling the capacities of the first and second compressors 51 and 52.

The first and second compressors 51 and 52 are constant-speed compressors, as described above. For this reason, the bypass device is used to control the capacities of the first and second compressors 51 and 52.

Specifically, the bypass device is disposed between the outlet parts of the first and second compressors 51 and 52 and the inlet part of the common accumulator 90. The bypass device comprises: a bypass channel 96 connected between the third compressor outlet pipe 95 and the outdoor unit refrigerant inlet pipe 56 for bypassing the discharged refrigerant when capacity less than the capacities of the first and second compressors 51 and 52, which are in operation, is required; a fourth cut-off valve 97 for opening and closing the bypass channel 96; and a capillary tube 98 mounted on the bypass channel 96 for reducing the pressure of the bypassed refrigerant.

In order to ensure that the pressure at the inlet part of the first compressor 51 is in equilibrium with the pressure at the outlet part of the first compressor 51 when the first compressor 51 is stopped, a first connection pipe 100 is connected between the first compressor inlet pipe 91 and the first compressor outlet pipe 93, and a fifth cut-off valve 101 is mounted on the first connection pipe 100.

In order to ensure that the pressure at the inlet part of the second compressor 52 is in equilibrium with the pressure at the outlet part of the second compressor 52 when the second compressor 52 is stopped, on the other hand, a second connection pipe 102 is connected between the second compressor inlet pipe 92 and the second compressor outlet pipe 94, and a sixth cut-off valve 103 is mounted on the second connection pipe 102.

The air conditioner according to the present invention further comprises: a controller (not shown) for controlling operations of the first, second and third indoor units 60, 70 and 80 and outdoor unit 50, performing a control operation such that cut-off valves of one or more indoor units, which are not in use, among the first, second and third indoor units 60, 70 and 80 are turned off, and cut-off valves of the other indoor units, which are in use, are turned on, and performing another control operation such that the fourth, fifth and sixth cut-off valves 97, 101 and 103 are turned on or off.

The operation of the air conditioner with the above-stated construction according to the present invention will be described below.

Refrigerant compressed by the first and second compressors 51 and 52 is introduced into the outdoor heat exchanger 54 through the first and second compressor outlet pipes 93 and 94 and the third compressor outlet pipe 95.

The outdoor heat exchanger 54 performs heat exchange between the refrigerant introduced into the outdoor heat exchanger 54 and outdoor air such that heat is transferred to the outdoor air to condense the refrigerant introduced into the outdoor heat exchanger 54.

The condensed refrigerant discharged from the outdoor heat exchanger 54 is introduced into the first, second and third indoor units 60, 70 and 80 through the outdoor unit refrigerant outlet pipe 55.

When the first, second and third indoor units 60, 70 and 80 are all in use as shown in FIG. 2, the first, second and third cut-off valves 65, 75 and 85 are operated in ON mode, and therefore, refrigerant discharged from the outdoor heat exchanger 54 is introduced into the first, second and third expansion devices 62, 72 and 82 through the first, second and third indoor unit refrigerant inlet pipes 63, 73 and 83, respectively.

The refrigerant introduced into the first, second and third expansion devices 62, 72 and 82 is expanded into low-temperature and low-pressure refrigerant while passing through the first, second and third expansion devices 62, 72 and 82. The expanded refrigerant absorbs heat from indoor air, and therefore, is evaporated while passing through the first, second and third indoor heat exchangers 61, 71 and 81. As a result, the interiors of rooms where the first, second and third indoor units 60, 70 and 80 are installed are cooled.

The evaporated refrigerant having passed through the first, second and third indoor heat exchangers 61, 71 and 81 flows through the first, second and third check valves 66, 76 and 86, is guided to the common accumulator 90 through the outdoor unit refrigerant inlet pipe 56, and is then introduced into the first and second compressors 51 and 52.

Figure 3:
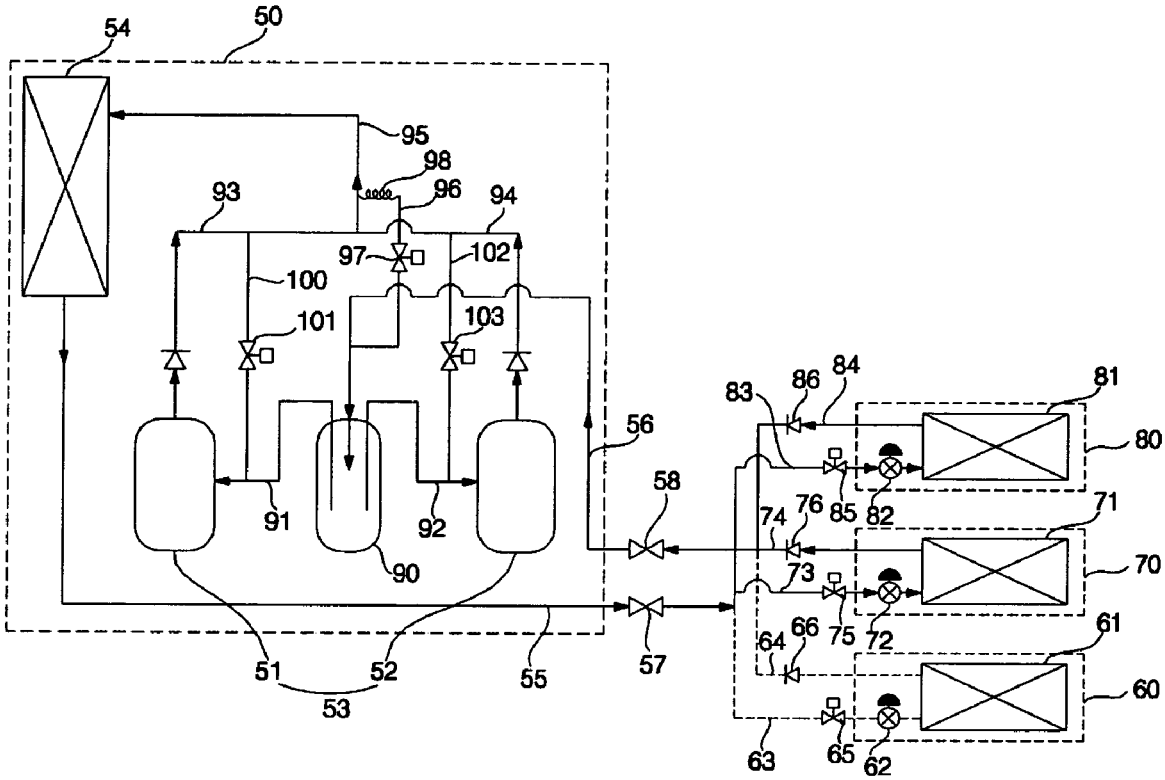
FIG. 3 is a circuit diagram schematically illustrating the structure of the air conditioner according to the present invention.

When at least one indoor unit among the first, second and third indoor units 60, 70 and 80 is not in use, for example, the first indoor unit 60 is not in use as shown in FIG. 3, the air conditioner according to the present invention is operated as follows.

When the first indoor unit 60 is not in use, the first cut-off valve 65 is operated in OFF mode while the second and third cut-off valves 75 and 85 are operated in ON mode. As a result, the first indoor unit refrigerant inlet pipe 63 is closed by the first cut-off valve 65.

Consequently, refrigerant is introduced into the second and third indoor units 70 and 80 from the outdoor unit 50 through the second and third indoor unit refrigerant inlet pipes 73 and 83. However, refrigerant is not introduced into the first indoor unit 60.

Specifically, refrigerant is introduced into the second and third indoor heat exchangers 71 and 81 through the second and third indoor unit refrigerant inlet pipes 73 and 83 and the second and third expansion devices 72 and 82, and is then introduced into the outdoor unit 50 through the second and third check valves 76 and 86.

In this way, the refrigerant is prevented from being introduced into the first indoor unit 60, and therefore, oil is prevented from being accumulated in the first indoor unit 60, which is not in use. In addition, an appropriate amount of refrigerant is supplied to only the second and third indoor units 70 and 80, and therefore, it is possible to control the amount of refrigerant.

Also, the first check valve 66 is mounted on the first indoor unit refrigerant outlet pipe 64, and therefore, the refrigerant is prevented from flowing backward to the first indoor unit 60, which is not in use.

When air-conditioner load is relatively small as compared to the capacity of the compressor 53, which is in operation, on the other hand, the capacity of the compressor 53 must be reduced. To this end, it is necessary to operate the fourth cut-off valve 97 in ON mode. When the fourth cut-off valve 97 is operated in ON mode, some of the refrigerant discharged from the first and second compressors 51 and 52 and then passing through the third compressor outlet pipe 95 flows through the capillary tube 98 mounted on the bypass channel 96. As a result, pressure of the refrigerant is reduced, and the reduced-pressure refrigerant is introduced into the common accumulator 90. In this way, refrigerant is bypassed.

Consequently, the capacity of the compressor 53 is properly controlled based on load.

When at least one compressor of the first and second compressors 51 and 52, for example, the first compressor 51, is stopped, the air conditioner according to the present invention is operated as follows.

When the first compressor 51 is stopped, the fifth cut-off valve 101 is opened, and therefore, refrigerant discharged from the first compressor 51 is introduced into the first compressor inlet pipe 91 through the first connection pipe 100, and is then introduced into the first compressor 51.

Consequently, pressure equilibrium is accomplished between the inlet and outlet parts of the first compressor 51.

As apparent from the above description, the air conditioner comprises valve devices mounted in a plurality of indoor units, respectively, for allowing refrigerant discharged from an outdoor heat exchanger to be introduced into one or more indoor units that are in operation. As a result, the refrigerant is prevented from being introduced into the other indoor units that are not in use, and therefore, oil is prevented from being accumulated in the other indoor units that are not in use. Also, an appropriate amount of refrigerant is supplied to the indoor units that are in operation, and therefore, reliability and efficiency of the air conditioner are improved.

Furthermore, the backward-flow preventing devices are disposed at the outlet parts of the indoor units for preventing refrigerant from flowing backward to the indoor units, and therefore, reliability of the air conditioner is further improved.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The present disclosure relates to subject matter contained in Korean Application No. 10-2004-0104358, filed on Dec. 10, 2004, the contents of which are herein expressly incorporated by reference in its entirety.

What is claimed is:

1. An air conditioner, comprising:

an outdoor heat exchanger mounted in an outdoor unit for exchanging heat between outdoor air and refrigerant discharged from a compressor;

indoor heat exchangers mounted in a plurality of indoor units;

expansion devices mounted in the plurality of indoor units, for expanding refrigerant introduced into the indoor heat exchangers from the outdoor heat exchanger; and valve devices mounted at the plurality of indoor units, for allowing the refrigerant discharged from the outdoor heat exchanger to be introduced into at least one operating indoor unit;

check valves disposed at outlet pipes of the indoor units for preventing refrigerant from flowing backward to the indoor units, and a service valve disposed at a merged outlet pipe which joins outlet pipes together.

2. The air conditioner as set forth in claim 1, wherein the valve devices are mounted on indoor unit refrigerant inlet pipes, which are connected to the indoor heat exchangers such that the refrigerant is introduced into the indoor heat exchangers through indoor unit refrigerant inlet pipes.

3. The air conditioner as set forth in claim 2, wherein the valve devices are cut-off valves for opening and closing the indoor unit refrigerant inlet pipes.

4. The air conditioner as set forth in claim 3, wherein the cut-off valves are disposed on the indoor unit refrigerant inlet pipes before the expansion devices.

5. The air conditioner as set forth in claim 4, wherein the compressor comprises first and second compressors, which are connected to each other via a common accumulator.

6. The air conditioner as set forth in claim 5, further comprising:

a bypass device disposed between the inlet and outlet parts of the compressor for controlling the capacity of the compressor.

7. The air conditioner as set forth in claim 6, wherein the bypass device comprises:

a bypass channel connected between the outlet part of the compressor and the inlet part of the common accumulator; and a cut-off valve for opening and closing the bypass channel.

8. The air conditioner as set forth in claim 7, wherein the bypass device further comprises:

a capillary tube mounted on the bypass channel for reducing the pressure of the refrigerant bypassed from the outlet part of the compressor to the inlet part of the common accumulator.

9. An air conditioner, comprising:

an outdoor heat exchanger mounted in an outdoor unit for exchanging heat between outdoor air and refrigerant discharged from a compressor;

indoor heat exchangers mounted in a plurality of indoor units;

expansion devices mounted in the plurality of indoor units, for expanding refrigerant introduced into the indoor heat exchangers from the outdoor heat exchanger;

valve devices mounted at the plurality of indoor units, for allowing the refrigerant discharged from the outdoor heat exchanger to be introduced into at least one operating indoor unit;

backward-flow preventing devices disposed at the outlet parts of the plurality of indoor units for preventing refrigerant from flowing backward to the indoor units;

a bypass channel connected between the outlet part of the compressor and the inlet part of an accumulator;

a cut-off valve for opening and closing the bypass channel;

a connection pipe connected between the compressor inlet pipe and the compressor outlet pipe; and a cut-off valve mounted on the connection pipe, said cut-off valve being opened such that a pressure at an inlet part of the compressor is in equilibrium with a pressure at an outlet part of the compressor when the compressor is stopped.

10. The air conditioner as set forth in claim 9, wherein the backward-flow preventing devices are check valves.

11. The air conditioner as set forth in claim 10, wherein the valve devices are mounted on indoor unit refrigerant inlet pipes, which are connected to the indoor heat exchangers such that the refrigerant is introduced into the indoor heat exchangers through indoor unit refrigerant inlet pipes.

12. The air conditioner as set forth in claim 11, wherein the valve devices are cut-off valves for opening and closing the indoor unit refrigerant inlet pipes.

13. The air conditioner as set forth in claim 12, wherein the cut-off valves are disposed on the indoor unit refrigerant inlet pipes before the expansion devices.

14. An air conditioner, comprising:

a plurality of compressors mounted in an outdoor unit, the compressors being connected to each other via a common accumulator;

an outdoor heat exchanger for exchanging heat between outdoor air and refrigerant discharged from the plurality of compressors;

indoor heat exchangers mounted in a plurality of indoor units;

expansion devices mounted in the plurality of indoor units, for expanding refrigerant introduced into the indoor heat exchangers from the outdoor heat exchanger;

valve devices mounted at the plurality of indoor units, for allowing the refrigerant discharged from the outdoor heat exchanger to be introduced into at least one operating indoor unit; and backward-flow preventing devices disposed at the outlet parts of the plurality of indoor units for preventing refrigerant from flowing backward to the indoor units;

a bypass channel connected between the outlet part of the compressor and the inlet part of the common accumulator;

a cut-off valve for opening and closing the bypass channel;

a connection pipe connected between the compressor inlet pipe and the compressor outlet pipe; and a cut-off valve mounted on the connection pipe, said cut-off valve being opened such that a pressure at an inlet part of the compressor is in equilibrium with a pressure at an outlet part of the compressor when the compressor is stopped.

15. The air conditioner as set forth in claim 14, wherein the valve devices are mounted on indoor unit refrigerant inlet pipes, which are connected to the indoor heat exchangers such that the refrigerant is introduced into the indoor heat exchangers through indoor unit refrigerant inlet pipes.

16. The air conditioner as set forth in claim 15, wherein the valve devices are cut-off valves for opening and closing the indoor unit refrigerant inlet pipes.

17. The air conditioner as set forth in claim 16, wherein the cut-off valves are disposed on the indoor unit refrigerant inlet pipes before the expansion devices.

18. The air conditioner as set forth in claim 17, wherein the backward-flow preventing devices are check valves.

* * * * *